US008791408B2

(12) United States Patent
Bowdler

(10) Patent No.: US 8,791,408 B2
(45) Date of Patent: Jul. 29, 2014

(54) METHODS AND APPARATUSES FOR PRODUCING MASS SPECTRUM DATA

(75) Inventor: Andrew Bowdler, Staffordshire (GB)

(73) Assignee: Kratos Analytical Limited, Manchester (GB)

( * ) Notice: Subject to any disclaimer, the term of this patent is extended or adjusted under 35 U.S.C. 154(b) by 0 days.

(21) Appl. No.: 13/810,968

(22) PCT Filed: Jul. 28, 2011

(86) PCT No.: PCT/GB2011/001138

§ 371 (c)(1),
(2), (4) Date: Jan. 18, 2013

(87) PCT Pub. No.: WO2012/017189

PCT Pub. Date: Feb. 9, 2012

(65) Prior Publication Data

US 2013/0119248 A1 May 16, 2013

(30) Foreign Application Priority Data

Aug. 2, 2010 (GB) ..... 1013016.9

(51) Int. Cl.
*H01J 49/00* (2006.01)
*H01J 49/26* (2006.01)

(52) U.S. Cl.
CPC ..... *H01J 49/0036* (2013.01); *H01J 49/0027* (2013.01); *H01J 49/0022* (2013.01)
USPC ..... 250/282; 250/281; 250/287; 250/288

(58) Field of Classification Search
CPC H01J 49/0022; H01J 49/0027; H01J 49/0036
USPC ..... 250/281, 282, 287, 288; 702/23
See application file for complete search history.

(56) References Cited

U.S. PATENT DOCUMENTS 7,365,309 B2 * 4/2008 Denny et al. ..... 250/282
7,409,298 B2 * 8/2008 Andreev et al. ..... 702/23

(Continued)

FOREIGN PATENT DOCUMENTS

EP 2112679 A2 10/2009
JP 2000206103 A * 7/2000 ..... G01N 30/86
JP 2000-299083 A 10/2000
JP 2011-102714 A 5/2011
WO WO 2008/092269 A1 8/2008

OTHER PUBLICATIONS

Norris et al. "Processing MALDI mass spectra to improve mass spectral direct tissue analysis", International Journal of Mass Spectrometry, vol. 260, Issues 2-3, Feb. 1, 2007, pp. 212-221.*
International Search Report and Written Opinion dated Jan. 18, 2012 corresponding to International Patent Application No. PCT/GB2011/001138.

*Primary Examiner* — Michael Logie
(74) *Attorney, Agent, or Firm* — Squire Patton Boggs (US) LLP

(57) ABSTRACT

The present invention is concerned with methods and apparatuses for generating mass spectrum data using a mass spectrometer by subtracting noise mass spectrum data representative of noise in the mass spectrometer from signal mass spectrum data representative of the mass/charge ratio of ions in a sample material. This produces a modified signal mass spectrum data representative of the mass/charge ratio of ions in the sample material. The method includes acquiring and subtracting noise mass spectrum data representative of noise in the mass spectrometer or alternatively subtracting noise mass spectrum data from a previously acquired or pre-stored noise spectrum data. Embodiments demonstrate reduced noise and in particular reduced systematic noise compared with the originally acquired signal mass spectrum data.

18 Claims, 7 Drawing Sheets

(56) References Cited

U.S. PATENT DOCUMENTS

2008/0026410 A1* 1/2008 Vlahou ..... 435/7.23
2008/0185510 A1* 8/2008 Ivosev ..... 250/282
2008/0272290 A1* 11/2008 Vestal ..... 250/287
2009/0266983 A1* 10/2009 Yamamoto et al. ..... 250/287
2013/0119248 A1* 5/2013 Bowdler ..... 250/282

* cited by examiner

METHODS AND APPARATUSES FOR PRODUCING MASS SPECTRUM DATA

FIELD OF THE INVENTION

This invention relates to methods and apparatuses for producing mass spectrum data using a mass spectrometer, e.g. a TOF mass spectrometer.

BACKGROUND

TOF mass spectrometry is an analytical technique for measuring the mass/charge ratio of ions by accelerating ions and measuring their time of flight to an ion detector.

In a simple form, a TOF mass spectrometer includes an ion source for generating a pulse (or burst) of ions of sample material and an ion detector for detecting ions that have travelled from the ion source to the ion detector. The ions generated by the ion source preferably have, e.g. because they have been accelerated to, a predetermined kinetic energy and so have different speeds according to their mass/charge ratio. Accordingly, as ions travel between the ion source and the ion detector, ions of different mass/charge ratios are separated by their different speeds and so are detected by the ion detector at different times, which allows their respective times of flight to be measured based on an output of the ion detector. In this way, mass spectrum data representative of the mass/charge ratio of ions of sample material can be acquired based on an output of the ion detector.

Matrix-assisted laser desorption/ionization, often referred to as "MALDI", is an ionisation technique in which, generally, a laser is used to fire light at a (usually crystallised) mixture of sample material and light absorbing matrix so as to ionise the sample material. The sample materials used with MALDI typically include molecules such as biomolecules (e.g. proteins), large organic molecules and/or polymers. The light absorbing matrix is generally used to protect such molecules from being damaged or destroyed by light from the laser. The resulting ions, which typically have masses of several thousand Daltons, are then accelerated to high kinetic energies, typically around 20 keV. Generally, an ion source configured to generate ions by MALDI is referred to as a "MALDI ion source". A MALDI ion source typically includes a laser for ionising sample material by firing light at a mixture of the sample material and light absorbing matrix.

MALDI is usually combined with time of flight mass spectrometry to provide "MALDI TOF" mass spectrometry in which, generally, a pulse of ions is generated by MALDI and the time of flight of the ions is then measured over distances typically of around 1-2 metres so that the mass/charge ratio of the ions can be determined.

Measuring the time of flight of ions in modern TOF mass spectrometers, e.g. MALDI TOF mass spectrometers, typically requires a diverse range of high speed digital and analogue electronics. For example, high speed timing electronics may be used in order to accurately synchronise various high-voltage electrical pulses with the firing of a laser and the acquisition of an ion signal. Also, kV/·s slew-rate high voltage electrical pulses may be used to accelerate, gate and steer ionised molecules generated by the laser. Finally, high speed multi-bit analogue to digital converters may be used to record the output from an ion detector so that the time of flight of the ions, and therefore the mass/charge ratio of the ions, can be determined. Such high speed digital and analogue electronics are typically run for each acquisition cycle of the TOF mass spectrometer.

Until recently, TOF mass spectrometers, e.g. MALDI TOF mass spectrometers, have used gas lasers having a repetition rate (rate at which it can fire pulses of light) of up to a few tens of Hz. More recent TOF mass spectrometers have used solid-state lasers capable of much higher repetition rates, e.g. 1 kHz or more.

The present inventors have found that high repetition rates of solid state lasers, combined with increasing clock speeds of digital electronics, has introduced new problems in the design of TOF mass spectrometers, particularly MALDI TOF mass spectrometers. These design problems include:

- how to generate multiple high-precision delays (e.g. with microsecond durations and sub-nanosecond resolution);
- how to stabilise power supplies to the electronics without radiating a lot of narrow-band electrical noise, especially for high-voltage pulses; and
- how to reduce the manifestation of noise in mass spectrum data produced by such MALDI TOF mass spectrometers.

The present invention has been devised in light of the above considerations.

SUMMARY OF THE INVENTION

In general, the invention relates to a method of producing mass spectrum data using a mass spectrometer by subtracting noise mass spectrum data representative of noise in the mass spectrometer from signal mass spectrum data representative of the mass/charge ratio of ions of sample material to produce modified signal mass spectrum data representative of the mass/charge ratio of ions of the sample material. As a result, the modified signal mass spectrum data preferably has reduced noise.

Accordingly, a first aspect of the invention may provide a method of producing mass spectrum data using a mass spectrometer having an ion source and an ion detector, wherein the method includes:

acquiring signal mass spectrum data representative of the mass/charge ratio of ions of sample material based on the output of the ion detector during at least one signal acquisition cycle in which ions of sample material generated by the ion source are detected by the ion detector; and subtracting noise mass spectrum data representative of noise in the mass spectrometer from the signal mass spectrum data to produce modified signal mass spectrum data representative of the mass/charge ratio of ions of the sample material.

As a result of this method, the modified signal mass spectrum data preferably has reduced noise. In particular, the modified signal mass spectrum data is able to have reduced systematic noise compared with the originally acquired signal mass spectrum data.

Preferably, the method includes acquiring the noise mass spectrum data representative of noise in the mass spectrometer based on the output of the ion detector during at least one noise acquisition cycle. By acquiring noise mass spectrum data using the mass spectrometer, the noise mass spectrum data is able to provide a good representation of any systematic noise in the signal mass spectrum data.

However, in some embodiments, the method does not include acquiring the noise mass spectrum data, e.g. because the noise mass spectrum data was acquired or produced at an earlier time, e.g. when the mass spectrometer was made. For example, the noise mass spectrum data subtracted from the signal mass spectrum data may be, or may be based on, pre-stored noise mass spectrum data, i.e. noise mass spectrum data that was stored (e.g. in a memory of the mass spectrometer) before the signal mass spectrum data was acquired. The pre-stored noise mass spectrum data may, for example, be averaged noise mass spectrum data and may have been stored a relatively long time (e.g. more than a day) before the signal mass spectrum was acquired, e.g. during initial testing of the mass spectrometer or when the mass spectrometer was built. An advantage of using pre-stored noise mass spectrum data is that it is not necessary to acquire noise mass spectrum data each time signal mass spectrum data is acquired. A disadvantage is that pre-stored noise mass spectrum data may not provide as good a representation of systematic noise in the mass spectrometer as acquiring noise mass spectrum data each time signal mass spectrum data is acquired, since, e.g. power supply voltages, temperature and other physical and electronic parameters which cause noise in the mass spectrometer may drift over time.

Preferably, in the at least one noise acquisition cycle, the ion detector does not detect any ions from the ion source. In this way, anything detected by the ion detector in the at least one noise acquisition cycle will, in general, be representative of noise in the mass spectrometer. Such noise may include random or systematic noise, as explained in more detail below.

It is to be observed that a noise acquisition cycle in which the ion detector does not detect any ions from the ion source can be implemented in at least two different ways. As a first example, a noise acquisition cycle in which the ion detector does not detect any ions from the ion source may be implemented by a noise acquisition cycle in which the ion source does not generate any ions of sample material, e.g. because a laser for ionising the sample material is not fired. As a second example, a noise acquisition cycle in which the ion detector does not detect any ions from the ion source may be implemented by a noise acquisition cycle in which the ion source generates ions of sample material but the ions generated by the ion source are prevented from being detected by the ion detector, e.g. because the ions generated by the ion source are prevented from reaching the ion detector, e.g. using a deflector and/or an einzel lens and/or an ion gate. Accordingly, in some embodiments, in the at least one noise acquisition cycle, either the ion source does not generate any ions of sample material or the ion source generates ions of sample material but the ions (of sample material) generated by the ion source are prevented from being detected by the ion detector.

Preferably, the or each noise acquisition cycle is as similar as practicable to the or each signal acquisition cycle, except that in the at least one noise acquisition cycle, the ion detector does not detect any ions from the ion source. In this way, the noise mass spectrum data is able to provide a good representation of any systematic noise in the signal mass spectrum data.

To this end, the or each noise acquisition cycle and the or each signal acquisition cycle preferably includes one or more of the following: producing one or more high voltage pulses (e.g. ±500V or greater, ±1 kV or greater), e.g. in one or more high voltage supplies of the mass spectrometer; supplying one or more high voltage pulses (e.g. ±500V or greater, ±1 kV or greater), e.g. from one or more high voltage supplies of the mass spectrometer, to one or more components of the mass spectrometer (e.g. an ion gate, a laser); and operating one or more motors of the mass spectrometer. As explained in detail below, these processes can be responsible for "analogue electronic noise" in mass spectrum data.

Similarly, the or each noise acquisition cycle and the or each signal acquisition cycle preferably includes operating electronics for producing mass spectrum data based on an output of the ion detector. This electronics may include, for example, an analogue input section, e.g. for conditioning an output from the ion detector; an analogue to digital converter, e.g. for digitising an output from the ion detector (e.g. as conditioned by an analogue input section); and one or more memories, e.g. for storing mass spectrum data. As explained in detail below, these processes can be responsible for "digital electronic noise" in mass spectrum data.

For simplicity, the or each noise acquisition cycle may be substantially the same as the or each signal acquisition cycle, except that in the or each noise acquisition cycle, either the ion source is not used to generate any ions of sample material or the ion source is used to generate ions of sample material but the ions generated by the ion source are not detected by the ion detector. For example, the or each noise acquisition cycle may be substantially the same as the or each signal acquisition cycle, except that in the or each noise acquisition cycle, a laser for ionising the sample material by firing light at the sample material is not fired to ionise the sample material. As another example, the or each noise acquisition cycle may be substantially the same as the or each signal acquisition cycle, except that ions of sample material generated by the ion source are prevented from reaching the ion detector, e.g. using a deflector and/or an einzel lens and/or an ion gate.

Preferably, the output from the ion detector at a particular moment in time is representative of the number of ions detected by the ion detector at that moment. For example, the output may represent the charge induced or the current produced when an ion has passed by and/or has hit the ion detector, with the amplitude of the output signal being representative of the number of ions detected by the ion detector.

The mass spectrum data may take any form capable of representing the mass/charge ratio of ions of sample material. In practice, this may be achieved by the mass spectrum data taking the form of data which relates an amplitude representative of the number of ions detected by the ion detector to time of flight or mass/charge ratio of the ions. Preferably, the times of flight (or mass/charge ratios) of the ions are grouped together within discrete time of flight (or mass/charge ratio) intervals or "bins", each time of flight (or mass/charge ratio) "bin" being representative of a range of times of flight (or mass/charge ratios). Accordingly, subtracting the noise mass spectrum data from the signal mass spectrum data may include subtracting an amplitude of each time of flight (or mass/charge ratio) "bin" of the noise mass spectrum data from a corresponding "bin" of the signal mass spectrum data.

In the context of this application, "subtracting the noise mass spectrum data from the signal mass spectrum data" is intended to mean any operation in which the noise mass spectrum data is, in effect, taken away (subtracted) from the signal mass spectrum data or in which the signal mass spectrum data is taken away (subtracted) from the noise mass spectrum data. In other words, subtracting signal mass spectrum data from noise mass spectrum data is taken to be equivalent to subtracting noise signal mass spectrum data from signal mass spectrum data for the purposes of this application.

If there are a plurality of signal acquisition cycles and a plurality of noise acquisition cycles, the noise mass spectrum data is preferably, for convenience, subtracted from the signal mass spectrum data after all the noise mass spectrum data and the signal mass spectrum data has been acquired. Alternatively, noise mass spectrum data acquired during each noise acquisition cycle may be subtracted from signal mass spectrum data acquired during a respective one of the signal acquisition cycles, so as to gradually build up the modified signal mass spectrum data.

The signal, noise, or modified signal mass spectrum data may be plotted as a mass spectrum showing amplitude against time of flight or mass/charge ratio, where the amplitude is representative of the number of ions that have been detected by the detector for a given time of flight or mass/charge ratio.

Preferably, the signal mass spectrum data is acquired based on the output of the ion detector during a plurality of the signal acquisition cycles. In other words, the signal mass spectrum data may be acquired over a plurality of cycles before the noise mass spectrum data is subtracted from it, with a distinct ions of sample material being generated by the ion source in each signal acquisition cycle. In this way, the proportion of random noise in the signal mass spectrum data can be reduced. The mass spectrum data acquired during each of the plurality of signal acquisition cycles may, for example, be accumulated, added or averaged to provide the signal mass spectrum data.

Preferably, the noise mass spectrum data is acquired based on the output of the ion detector during a plurality of the noise acquisition cycles. In other words, the noise mass spectrum data may be acquired over a plurality of cycles before it is subtracted from the signal mass spectrum data. In this way, the proportion of random noise in the noise mass spectrum data may be reduced. The mass spectrum data acquired during each of the plurality of noise acquisition cycles may, for example, be accumulated, added or averaged to provide the signal mass spectrum data.

The method may include acquiring the noise mass spectrum data in a plurality of segments, each segment of noise mass spectrum data preferably being representative of noise in the mass spectrometer across a respective mass/charge ratio range and preferably being acquired based on the output of the ion detector during at least one respective noise acquisition cycle. An advantage of acquiring the noise mass spectrum data in a plurality of segments is that the time between (noise) acquisition cycles can be reduced, since the present inventors have found that, in practice, the time taken to store (e.g. by accumulating) noise mass spectrum data representative of noise in the mass spectrometer across a full mass/charge ratio range into memory can take longer than the time taken to produce the noise mass spectrum data in the first place, e.g. because the time taken to store noise mass spectrum data is longer than the time of flight of ions in the mass spectrometer. Acquiring the noise mass spectrum data in a plurality of segments is able to work because systematic noise does not, in general, vary greatly between acquisition cycles.

If the noise mass spectrum data is acquired in a plurality of segments, the number of noise acquisition cycles may be greater than the number of signal acquisition cycles by a factor of the number of segments. This is useful in making the "effective" number of noise acquisition cycles equal to the number of signal acquisition cycles.

The method may further include subtracting the plurality of segments of noise mass spectrum data from the signal mass spectrum data to produce modified signal mass spectrum data representative of the mass/charge ratio of ions of the sample material. This may be achieved by combining the plurality of segments of noise mass spectrum data to form composite noise mass spectrum data (e.g. representative of noise in the mass spectrometer across a full mass/charge ratio range) and then subtracting the composite noise mass spectrum data from the signal mass spectrum data. Alternatively, the plurality of segments of noise mass spectrum data may be individually subtracted from the signal mass spectrum data to produce the modified signal mass spectrum data without combining the individual segments.

Preferably, a plurality of signal acquisition cycles and a plurality of noise acquisition cycles are performed in consecutive cycles of the mass spectrometer, preferably with a small time difference between the consecutive cycles, e.g. a time difference between the consecutive cycles of 1 second or less, more preferably 100 milliseconds or less, more preferably 10 milliseconds or less, more preferably 1 milliseconds or less, more preferably 100 microseconds or less. In this way, the noise mass spectrum data can have very similar characteristics to the noise in the signal mass spectrum data and so can be subtracted from the signal mass spectrum data to produce modified signal mass spectrum data having an improved signal to noise ratio since, e.g. power supply voltages, temperature and other physical and electronic parameters within the mass spectrometer can drift over time. However, although it has been found that better signal to noise ratio is generally achieved with a small time difference, it has also been found that an acceptable signal to noise ratio can be achieved with larger time differences, e.g. time differences of hours or even days.

A plurality of signal and noise acquisition cycles may be performed in any order. However, preferably, a plurality of signal acquisition cycles are interleaved with a plurality of noise acquisition cycles, i.e. such that signal acquisition cycles are performed between noise acquisition cycles and vice versa. In this way, the noise mass spectrum data can have very similar characteristics to the noise in the signal mass spectrum data and so can be subtracted from the signal mass spectrum data to produce modified signal mass spectrum data having an improved signal to noise ratio. However, the plurality of signal acquisition cycles may be performed separately from the plurality of noise acquisition cycles, i.e. without interleaving.

Regardless of whether the signal and noise acquisition cycles are interleaved, the plurality of signal and noise acquisition cycles are performed in consecutive cycles of the mass spectrometer, preferably with a small time difference between the consecutive cycles as described above.

For simplicity, the number of signal acquisition cycles may be equal to the number of noise acquisition cycles. However, the number of signal and noise acquisition cycles, may, in some embodiments, be unequal. Unequal numbers of signal and noise acquisition cycles may be useful, for example, if the noise mass spectrum data is acquired in segments (e.g. as explained above).

If the number of signal acquisition cycles is not equal to the number (or "effective" number) of noise acquisition cycles, then the signal mass spectrum data and/or the noise mass spectrum data may be scaled according to the number of acquisition cycles used to acquire the data. In this way, the amount of noise subtracted from the signal mass spectrum data is able to correspond with the actual noise present in the signal mass spectrum data.

Preferably, the method includes subtracting the noise mass spectrum data from the signal mass spectrum data in a pre-processing unit coupled to a processing unit for analysing signal mass spectrum data. The processing unit may, for example, be a computer, which may be programmed with software for analysing mass spectrum data from the TOF mass spectrometer. Preferably, the method includes transferring the modified signal mass spectrum data from the pre-processing unit to the processing unit, e.g. for subsequent analysis by the processing unit.

The method may include acquiring the signal and/or the noise mass spectrum data in the pre-processing unit.

The method may include storing (e.g. by accumulating) the signal mass spectrum data in a first memory in the pre-processing unit and/or storing (e.g. by accumulating) the noise mass spectrum data in a second memory in the pre-processing unit.

By using such a pre-processing unit, it becomes possible to produce the modified signal mass spectrum data before it is analysed by the processing unit. This can provide a significant reduction in the time taken to produce and analyse the modified signal mass spectrum data, since it is not necessary for the processing unit to both produce and analyse the modified signal mass spectrum data. Also, by using a pre-processing unit, significantly less data needs to be transferred to the processing unit, since only the modified mass spectrum data, rather than the signal mass spectrum data and the noise mass spectrum data, needs to be transferred. Also, by using a pre-processing unit, it is not necessary to configure the processing unit to carry out the subtraction.

Although it is preferred to use a pre-processing unit as described above, in some embodiments, the noise mass spectrum data may be subtracted from the signal mass spectrum data to produce the modified signal mass spectrum data in a processing unit for analysing mass spectrum data.

A second aspect of the invention relates to a mass spectrometer for implementing a method according to the first aspect of the invention.

Accordingly, a second aspect of the invention may provide a mass spectrometer having:

an ion source for generating ions of sample material;

an ion detector for detecting ions of sample material generated by the ion source;

a first data acquisition means for acquiring signal mass spectrum data representative of the mass/charge ratio of ions of sample material based on the output of the ion detector during at least one signal acquisition cycle in which ions of sample material generated by the ion source are detected by the ion detector; and a subtraction means for subtracting noise mass spectrum data representative of noise in the mass spectrometer from signal mass spectrum data produced by the first data acquisition means to produce modified signal mass spectrum data representative of the mass/charge ratio of ions of the sample material.

The mass spectrometer may be configured to, or have means for, implementing any method step described in connection with the first aspect.

For example, the mass spectrometer preferably has a second data acquisition means for acquiring the noise mass spectrum data representative of noise in the mass spectrometer based on the output of the ion detector during at least one noise acquisition cycle, e.g. in which the ion detector does not detect any ions from the ion source. However, the second data acquisition means may be omitted in some embodiments, e.g. with the subtraction means being configured to subtract pre-stored noise mass spectrum data from signal mass spectrum data produced by the first data acquisition means. The mass spectrometer may include a memory for storing the pre-stored noise mass spectrum data.

As another example, the mass spectrometer is preferably configured such that the or each noise acquisition cycle and the or each signal acquisition cycle includes one or more of the following: producing one or more high voltage pulses; supplying one or more high voltage pulses to one or more components of the mass spectrometer; and operating one or more motors of the mass spectrometer.

As another example, the mass spectrometer is preferably configured such that the or each noise acquisition cycle and the or each signal acquisition cycle includes operating electronics (which electronics is preferably included in the mass spectrometer) for producing mass spectrum data based on an output of the ion detector.

As another example, for simplicity, the mass spectrometer may be configured such that the or each noise acquisition cycle is substantially the same as the or each signal acquisition cycle, except that in the or each noise acquisition cycle, either the ion source is not used to generate any ions of sample material or the ion source is used to generate ions of sample material but the ions generated by the ion source are not detected by the ion detector.

As another example, the mass spectrometer may include means for plotting the signal, noise, or modified signal mass spectrum data as a mass spectrum showing amplitude against time of flight or mass/charge ratio, where the amplitude is representative of the number of ions that have been detected by the detector for a given time of flight or mass/charge ratio.

As another example, the mass spectrometer may be configured such that the signal mass spectrum data is acquired based on the output of the ion detector during a plurality of the signal acquisition cycles and/or such that the noise mass spectrum data is acquired based on the output of the ion detector during a plurality of the noise acquisition cycles.

As another example, the second data acquisition means may be for acquiring the noise mass spectrum data in a plurality of segments, each segment of noise mass spectrum data preferably being representative of noise in the mass spectrometer across a respective mass/charge ratio range and preferably being acquired based on the output of the ion detector during at least one respective noise acquisition cycle. The mass spectrometer may further include means for subtracting the plurality of segments of noise mass spectrum data from the signal mass spectrum data to produce modified signal mass spectrum data representative of the mass/charge ratio of ions of the sample material.

As another example, the mass spectrometer may be configured such that a plurality of signal acquisition cycles and a plurality of noise acquisition cycles are performed in consecutive cycles of the mass spectrometer, preferably with a small time difference between the consecutive cycles, e.g. a time difference between the consecutive cycles of 1 second or less, more preferably 100 milliseconds or less, more preferably 10 milliseconds or less, more preferably 1 milliseconds or less, more preferably 100 microseconds or less.

As another example, the mass spectrometer may be configured such that a plurality of signal acquisition cycles are interleaved with a plurality of noise acquisition cycles.

As another example, the mass spectrometer may be configured such that the number of signal acquisition cycles is equal to the number of noise acquisition cycles.

As another example, the mass spectrometer may include means for scaling the signal mass spectrum data and/or the noise mass spectrum data according to the number of acquisition cycles used to acquire the data.

As another example, preferably, the subtraction means is included in a pre-processing unit coupled to a processing unit for analysing signal mass spectrum data. Preferably, the pre-processing unit includes a data transfer means for transferring modified mass signal mass spectrum data to the processing unit, e.g. for subsequent analysis by the processing unit. Preferably, the pre-processing unit includes a first memory for storing the signal mass spectrum data and/or a second memory for storing the noise mass spectrum data.

As another example, the pre-processing unit may include the first and/or second data acquisition means.

In any above aspect, the ion source may include a laser for ionising sample material by firing light at the sample material.

Preferably, the laser is for ionising sample material by firing pulses of light at the sample material. The laser preferably produces UV light. Accordingly, an above described signal acquisition cycle may include the laser firing a pulse of light at the sample material to generate a pulse of ions of the sample material.

In any above aspect, the ion source may be a MALDI ion source. For a MALDI ion source, the sample material may include biomolecules (e.g. proteins), organic molecules and/or polymers. The sample material may be included in a (preferably crystallised) mixture of sample material and light absorbing matrix. The light absorbing matrix may include DCTB (T-2-(3-(4-t-Butyl-phenyl)-2-methyl-2-propenylidene)malononitrile), DHB (2,5-dihydroxybenzoic acid), SA (sinapinic acid), DTL (1,8,9-anthrecenetriol (dithranol)) or CHCA (•-Cyano-4-hydroxycinnamic acid), for example.

In any above aspect, the ion source may include acceleration means for accelerating ions generated by the ion source to a predetermined kinetic energy. The acceleration means may include at least one acceleration electrode for producing an electric field to accelerate ions generated by the ion source to a predetermined kinetic energy. An above described method may include accelerating ions (e.g. generated by a laser for ionising sample material) to a predetermined kinetic energy using the acceleration means, e.g. to accelerate a pulse of ions generated by the ion source.

In any above aspect, the ion source may include a sample holding means for holding sample material to be ionised by the ion source. The sample holding means may include a sample plate for holding sample material in one or more "sample spots". The sample holding means may include a sample plate carrier for carrying a sample plate. The sample plate is preferably configured to be removed from the ion source whereas the sample plate carrier may be non-removably mounted within the ion source.

In any above aspect, the ion source preferably includes a housing, e.g. for containing the acceleration means and/or a sample holding means. The housing is preferably configured to be evacuated, i.e. configured to contain a vacuum.

In any above aspect, the mass spectrometer may include one or more ion gates for selecting ions to be detected.

In any above aspect, the mass spectrometer may include a reflectron. A reflectron is an ion mirror that, in use, reflects the ions in a pulse of ions back in the direction of an ion source to an ion detector, which may detect the ions after they have been reflected. One advantage of using a reflectron is that it generally produces higher mass resolution than using a linear ion detector (and therefore better mass accuracy), albeit with generally a lower maximum mass range.

In any above aspect, the mass spectrometer may include a flight tube in which the ion source and ion detector are located. Other components, e.g. a reflectron may also be located in the flight tube. The flight tube is preferably evacuated when the mass spectrometer is in use.

In any above aspect, the mass spectrometer may be a TOF mass spectrometer. Thus, for example, in each acquisition cycle, the ion source may generate a pulse of ions of sample material (e.g. by a laser firing a pulse of light at the sample material) such that ions of the sample material are detected by the ion detector. The TOF mass spectrometer may be a MALDI TOF mass spectrometer.

The invention also includes any combination of the aspects and preferred features described except where such a combination is clearly impermissible or expressly avoided.

BRIEF DESCRIPTION OF THE DRAWINGS

Embodiments of these proposals are discussed below, with reference to the accompanying drawings in which.

DESCRIPTION OF EMBODIMENTS AND EXPERIMENTS

Figure 1:
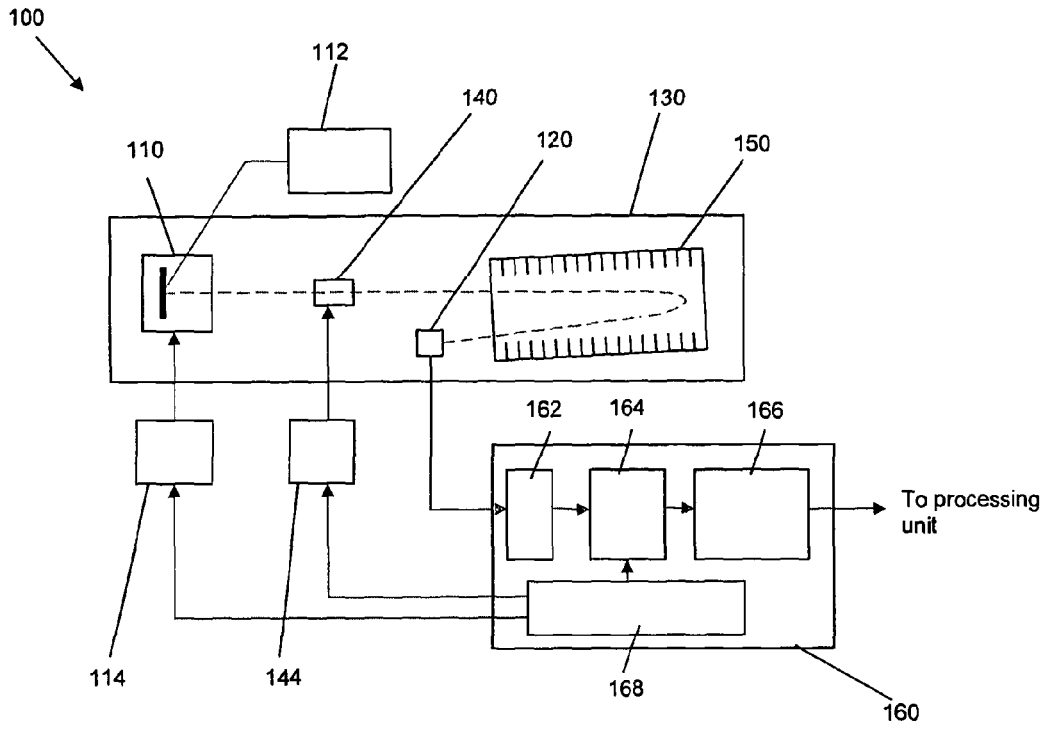
FIG. 1 is a schematic diagram showing a TOF mass spectrometer configuration used by the present inventors before the development of the present invention.

FIG. 1 is a schematic diagram showing a TOF mass spectrometer configuration, including a mass spectrometer 100, used by the present inventors before the development of the present invention.

The mass spectrometer 100 shown in FIG. 1 has an ion source 110 for generating a pulse of ions of sample material and an ion detector 120 for detecting ions of sample material generated by the ion source 110. The ion source 110 and ion detector 120 are located in an evacuated flight tube 130.

The ion source 110 includes a laser 112 for ionising sample material by firing pulses of (preferably UV) light at the sample material. In a MALDI TOF mass spectrometer, the sample material may be included in a crystalised mixture of the sample material and light absorbing matrix. The laser 112 fires a pulse of light when it is supplied with a high voltage pulse (typically ±1 kV or greater) from an associated high voltage supply 114. In a modern mass spectrometer, the laser 112 may be a solid state laser, capable of a high repetition rate, e.g. 1 kHz or more.

Because TOF mass spectrometry is a pulsed technique, in which individual pulses, rather than a continuous stream, of ions are produced, other components which in use are supplied with high voltage pulses may be located in the flight tube 130.

For example, an ion gate 140 for selecting ions to be detected by the ion detector 120 may be located in the flight tube 130. The ion gate 140 is able to select ions to be detected by the ion detector 120 by producing an electric field to deflect unwanted ions away from the direction of the ion detector 120, when it is supplied with a high voltage pulse (typically ±500V, although greater voltages can be used) from an associated high voltage supply 144. The ion gate may, for example, include interleaved wires. When the ion gate 140 is opened or closed, the high voltage supply 144 is typically switched at very high speed, preferably at time intervals of around 10 ns or less.

The mass spectrometer 100 may also include a reflectron 150. The reflectron 150 is an ion mirror that reflects the ions in an ion pulse back in the direction of the ion source 110 to be detected by the ion detector 120.

The mass spectrometer 100 also has electronics for producing mass spectrum data based on an output of the ion detector 120, which electronics is preferably located in a pre-processing unit 160 (or "transient recorder"). The electronics for producing mass spectrum data includes an analogue input section 162 for conditioning an output from the ion detector 120, an analogue to digital converter 164 for digitising the output from the ion detector 120 (as conditioned by the analogue input section 162) at very high speed (typically less than 1 ns between digitisation points), and a memory 166 for storing signal mass spectrum data representative of the mass/charge ratio of ions of sample material before it is transferred to an external processing unit (not shown), such as a computer.

The pre-processing unit 160 also includes timing electronics 168 for the operation of one or more components of the mass spectrometer 100 to a trigger signal and/or for synchronising data produced by (e.g. an analogue to digital converter of) the mass spectrometer to a trigger signal. The trigger signal may indicate the occurrence of a trigger event within the mass spectrometer, e.g. the firing of a laser for ionising sample material.

In use, the mass spectrometer 100 performs one or more signal acquisition cycles in which the ion source 110 is used to generate a pulse of ions of sample material such that ions of the sample material are subsequently detected by the ion detector 120. Preferably, the pulse of ions during each signal acquisition cycle is produced by the laser 112 firing a pulse of light at the sample material, with the ionised sample material being accelerated by acceleration electrodes (not shown) to a pre-determined kinetic energy. An output from the ion detector 120 is fed to the electronics for producing mass spectrum data in the pre-processing unit 160 which conditions and digitises the output and then stores, in the memory 166, mass spectrum data representative of the mass/charge ratio of ions of the sample material based on the conditioned and digitised output signal during the one or more signal acquisition cycles.

The mass spectrum data collected in one or more acquisition cycles may be plotted as a mass spectrum, showing amplitude against time of flight or mass/charge ratio, where the amplitude is representative of the number of ions that have been detected by the detector for a given time of flight or mass/charge ratio.

For generally all mass spectrometers, e.g. the mass spectrometer 100 shown in FIG. 1, the mass spectrum data produced will generally contain unwanted noise in addition to the signal from the ionised sample material. This noise can manifest itself as extra peaks in a mass spectrum and/or as a background signal. Ideally, all noise would be reduced in the mass spectrum data so that the signal to noise ratio is maximized and even the weakest signals of sample material can be measured.

Noise in mass spectrum data produced by a mass spectrometer can be random or systematic in nature.

Random noise, by definition, is different every time mass spectrum data is acquired and so the signal to noise level can be improved simply by acquiring mass spectrum data over many acquisition cycles. The mass spectrum data acquired over the many acquisition cycles may be averaged together, for example. This is normal practice for mass spectrometers and mass spectrum data is usually acquired or accumulated until the signal to noise ratio reaches an acceptable value or does not improve further.

Systematic noise, however, cannot be reduced to an acceptable level to obtain a desired signal to noise ratio simply by acquiring more mass spectrum data or by performing more acquisition cycles.

Two principle origins of systematic noise in mass spectrum data produced by TOF mass spectrometers may be termed "ion noise" and "electronic noise" and will be described with reference to the mass spectrometer 100 shown in FIG. 1.

"Ion noise" is produced inside the mass spectrometer 100 in the form of extra ion signal being detected. Such noise, which can be chemical or background noise, is generated only when the laser 112 is fired and when the sample material is ionised, and so it is difficult to distinguish this noise from a real signal originating from ions of the sample material.

"Electronic noise" is generally produced in electronic circuits between and within the ion detector 120 and the pre-processing unit 160. Electronic noise can be broadly categorized by whether it is produced before or after the signal goes into the pre-processing unit 160. Noise generated outside the pre-processing unit 160 may be referred to as "analogue electronic noise" whereas noise produced inside the pre-processing unit 160 may be referred to as "digital electronic noise".

Figure 2:
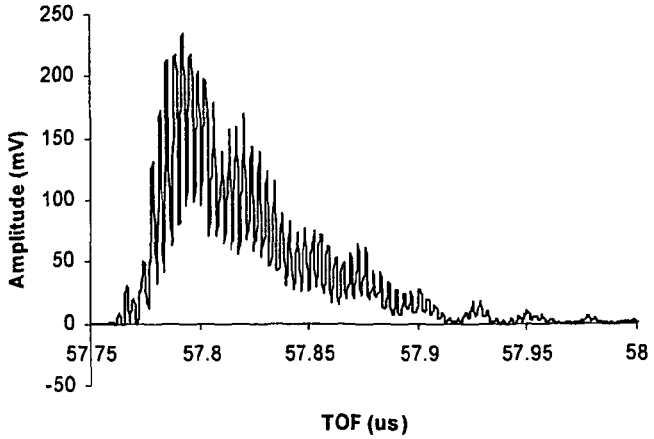
FIG. 2 is a mass spectrum showing an example of "analogue electronic noise".

"Analogue electronic noise" may be caused by analogue electronic circuits and is generally added to mass spectrum data before the output signal from the detector 120 goes into the pre-processing unit 160. FIG. 2 is a mass spectrum showing an example of "analogue electronic noise" which can be generated, for example, by the high voltage pulses supplied to the ion gate 140 which is used to prevent or blank out unwanted ions from reaching the ion detector 120. Electronic noise, e.g. from wires of the ion gate 140, may be radiated inside the evacuated flight tube 130 and can be picked up in the output signal of the ion detector 120 when the ion gate 140 is located too close to the ion detector 120 or is not very well shielded.

Analogue electronic noise can also be picked up externally through power supplies and leads for high-voltage supplies that, in use, supply high voltage pulses e.g. the high voltage supply 144 associated with the ion gate 140. Analogue electronic noise will be systematic in nature but will vary slightly from one acquisition cycle to another. It is not usually related to a clock of the pre-processing unit 160, so there will not, in general, be any relationship between analogue electronic noise and the time difference between acquisition cycles. Analogue electronic noise may also be caused by operating one or more motors of the mass spectrometer.

Figure 3:
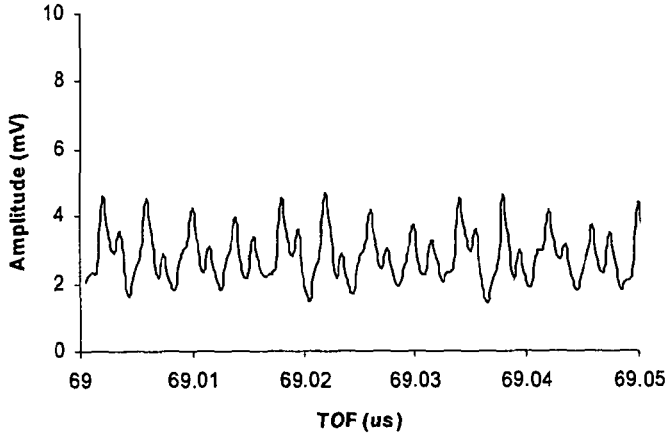
FIG. 3 is a mass spectrum showing an example of "digital electronic noise".

"Digital electronic noise" may be caused by the electronics for producing mass spectrum data which is preferably located in the pre-processing unit 160. This noise can originate from analogue electronics on the input side just before the analogue to digital convertor 164. Digital electronic noise can also be generated in the digital electronics of the pre-processing unit 160. Because of this, the digital noise is more systematic, e.g. regular or periodic, than the analogue electronic noise. Digital electronic noise usually has characteristics relating to binary multiples of a clock of the pre-processing unit 160. In particular, the shape of the digital electronic noise often repeats after 8, 16, 32 and 64 time intervals ("bins") of the pre-processing unit 160. FIG. 3 is a mass spectrum showing an example of "digital electronic noise", where the repetitive (or periodic) structure corresponding to binary multiples of the time intervals ("bins") of the pre-processing unit 160 can be clearly seen.

The present inventors have noted that, unlike random noise, systematic noise, whether it is generated outside of the pre-processing unit (analogue electronic noise) or inside the pre-processing unit (digital electronic noise) does not average to zero as more mass spectrum data is acquired. Therefore, systematic noise can appear as extra peaks in a mass spectrum which can be confused with, or even obscure the peaks from the ionised sample material.

At best, systematic noise reduces the signal to noise ratio. At worst, systematic noise can stop signal from the ionised sample material from being detected altogether. In either case, the effect is to reduce the sensitivity of a mass spectrometer.

Figure 4:
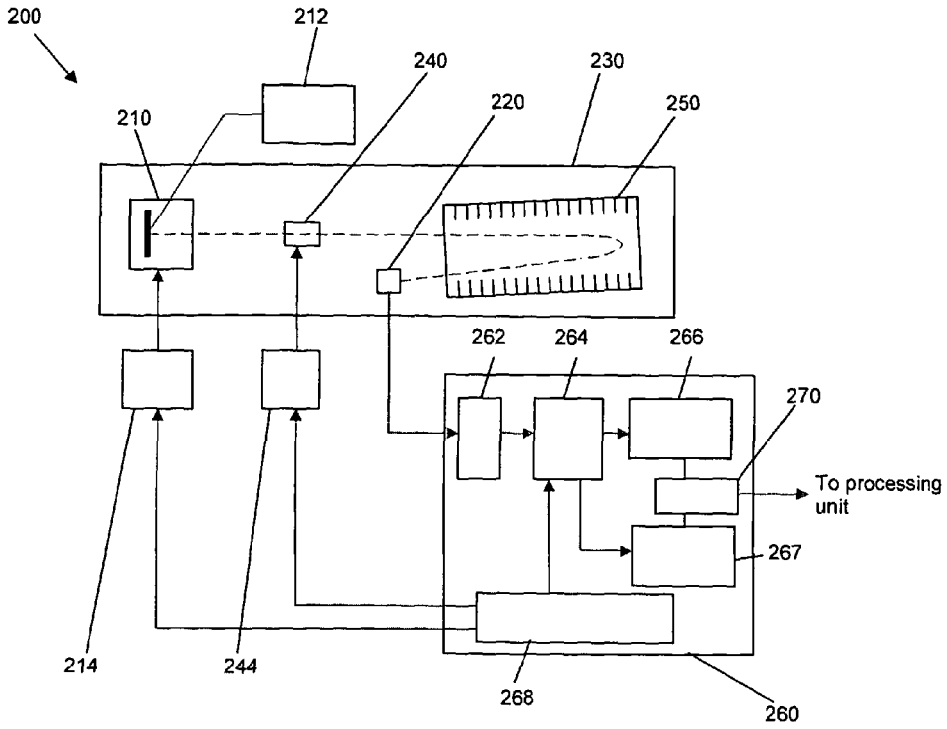
FIG. 4 is a schematic diagram showing a TOF mass spectrometer configuration used by the present inventors after the development of the present invention.

FIG. 4 is a schematic diagram showing a TOF mass spectrometer configuration, including a mass spectrometer 200, used by the present inventors after the development of the present invention.

Many features of the mass spectrometer 200 shown in FIG. 4 are the same as those of the mass spectrometer 100 shown in FIG. 1. These features have been given corresponding reference numerals and need not be discussed in further detail.

A difference between the mass spectrometer 200 shown in FIG. 4 and the mass spectrometer 100 shown in FIG. 1 is that the pre-processing unit 260 of the mass spectrometer 200 shown in FIG. 4 has a second memory 267 and a subtracting unit 270.

In use, the mass spectrometer 200 performs one or more signal acquisition cycles in which the ion source 210 is used to generate a pulse of ions of sample material such that ions from the pulse are subsequently detected by the ion detector 220. An output from the ion detector 220 is fed to the pre-processing processing unit 260 which conditions and digitises the output and then stores, in the first memory 266, signal mass spectrum data representative of the mass/charge ratio of ions of the sample material based on the conditioned and digitised output signal during the one or more signal acquisition cycles. This is very similar to the operation of the mass spectrometer 100 shown in FIG. 1.

In use, the mass spectrometer 200 also performs one or more noise acquisition cycles in which the ion detector 220 does not detect any ions from the ion source 210. Preferably, the or each noise acquisition cycle is substantially the same as the or each signal acquisition cycle, except that in the or each noise acquisition cycle, the laser 212 is not fired to ionise the sample material or ions of sample material generated by the ion source 210 are prevented from reaching the ion detector 220, e.g. using the ion gate 240. An output signal from the ion detector 220 is fed to the pre-processing unit 210 which conditions and digitises the output signal and then stores, in the second memory 267, noise mass spectrum data representative of noise in the mass spectrometer based on the conditioned and digitised output signal during the one or more noise acquisition cycles.

Next, the subtracting unit 270 subtracts the noise mass spectrum data from the signal mass spectrum data to produce modified signal mass spectrum data representative of the mass/charge ratio of ions of the sample material. In this way, the modified signal mass spectrum data is able to have reduced systematic noise compared with the originally acquired, i.e. unmodified, signal mass spectrum data.

The modified signal mass spectrum data collected in each acquisition cycle may be plotted as a mass spectrum, showing amplitude against time of flight or amplitude against mass/charge ratio, where the amplitude is representative of the number of ions that have been detected by the detector for a given time of flight or mass/charge ratio.

As more signal and noise mass spectrum data is acquired, systematic noise will, in general, average to the same value. Accordingly, if the noise mass spectrum data is acquired using an adequate number of noise acquisition cycles, the noise mass spectrum data will have very similar characteristics to the noise in the signal mass spectrum data and so can be subtracted from the signal mass spectrum data to produce modified signal mass spectrum data having an improved signal to noise ratio.

The acquisition of the noise mass spectrum data can be carried out at a different time to the signal mass spectrum data or it can be carried out at the same time, e.g. by interleaving noise acquisition cycles with the signal acquisition cycles, as will be described below in more detail with reference to FIGS. 5-7.

Preferably, subtraction of the noise mass spectrum data from the signal mass spectrum data is performed in a pre-processing unit, such as the pre-processing unit 260 shown in the mass spectrometer of FIG. 4.

However, in other embodiments, the subtraction may be performed in a processing unit for analysing mass spectrum data, such as a computer. For example, in some embodiments, the mass spectrometer shown in FIG. 1 may be configured to separately acquire signal mass spectrum data and noise mass spectrum data in the memory 166 and to transfer that data to a separate processing unit, which may also be a processing unit for analysing mass spectrum data, with the separate processing unit being configured to subtract the noise mass spectrum data from the signal mass spectrum data.

Although acquiring noise and signal mass spectrum data separately and at different times and subtracting the noise mass spectrum data from the signal mass spectrum data in a separate processing unit can provide a significant performance improvement compared with the performance of existing mass spectrometers, there are some disadvantages in doing this.

A first disadvantage of accumulating and subtracting the signal and noise mass spectrum data in the processing unit that is also used for analysing the mass spectrum data is that the longer the time between collecting the noise and the signal mass spectrum data, the further apart the characteristics of the noise in the signal mass spectrum data are from the noise in the noise mass spectrum data. This is because, e.g., power supply voltages, temperature and other physical and electronic parameters can drift over time. Also, settings in the mass spectrometer can change between samples or different modes of operation and even if set back to the values used for the original spectra, the noise can be changed in ways subtly different from when the signal mass spectrum data was collected.

Ideally, the noise and signal spectra would be acquired at the same time. This can, in effect, be done if the mass spectrometer is configured to carry out the signal and noise acquisition cycles in consecutive acquisition cycles, with the signal acquisition cycles being interleaved with the noise acquisition cycles, with the resulting signal and noise mass spectrum data being stored separately, e.g. in the separate memories 266 and 270 shown in FIG. 4.

Figure 5:
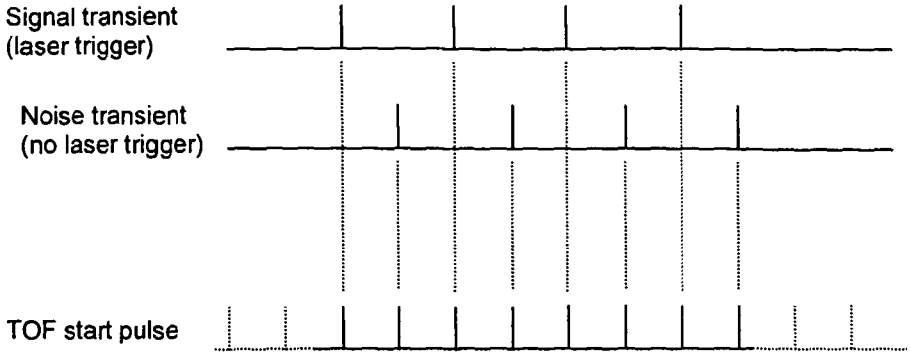
FIGS. 5-7 illustrate different ways of interleaving a plurality of "signal" acquisition cycles with a plurality of "noise" acquisition cycles.
Figure 6:
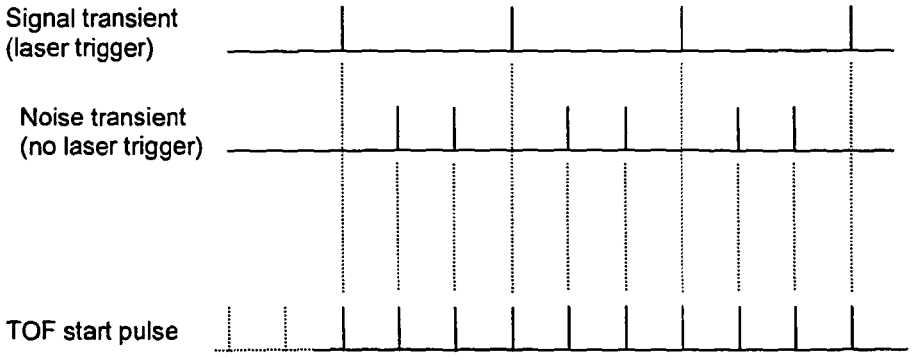
Figure 7:
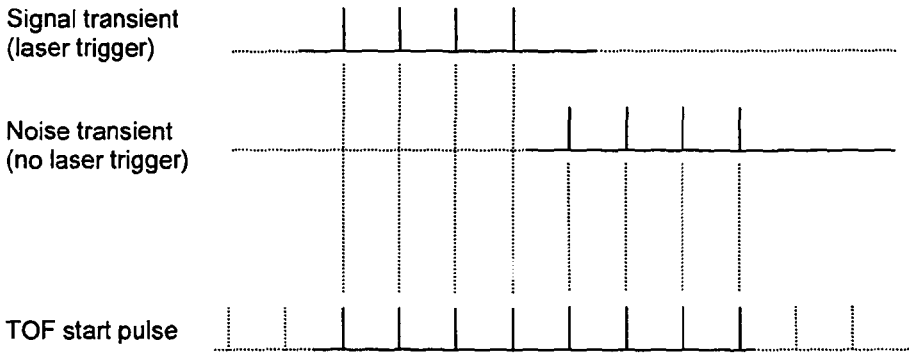

FIGS. 5-7 illustrate different ways of interleaving a plurality of signal acquisition cycles with a plurality of noise acquisition cycles.

For example, the signal and noise acquisition cycles can be performed alternately as shown in FIG. 5. As another example, multiple noise acquisition cycles can be performed between the signal acquisition cycles as shown in FIG. 6, where two noise acquisition cycles are performed for each signal acquisition cycle. As a yet further example, the signal and noise acquisition cycles can be performed in small groups which are interleaved as shown in FIG. 7 where four signal acquisition cycles are performed followed by four noise acquisition cycles and so on. Before subtracting noise mass spectrum data from the signal mass spectrum data, the amplitude of the noise mass spectrum data and/or the signal mass spectrum data is preferable scaled according to the number of respective acquisition cycles.

A second disadvantage of accumulating and subtracting the signal and noise mass spectrum data in the processing unit that is also used for analysing the mass spectrum data is that the time taken to carry out the acquisition and subtraction of the noise mass spectrum data can add significantly to the overall time taken to perform experiments. For example, when carried out in a computer, it can take several seconds to transfer and process signal and noise mass spectrum data for reasonable mass ranges. For example a mass range of several thousand Daltons may correspond to more than 100 us, i.e. 100 microseconds, and with very high resolution pre-processing unit running at multi-GHz sample rates, this can require millions of individual calculations in the computer. Also, if the subtraction is carried out by the pre-processing unit there is only one set of mass spectrum data (the modified signal mass spectrum data) to transfer to and process in the computer.

Figure 8:
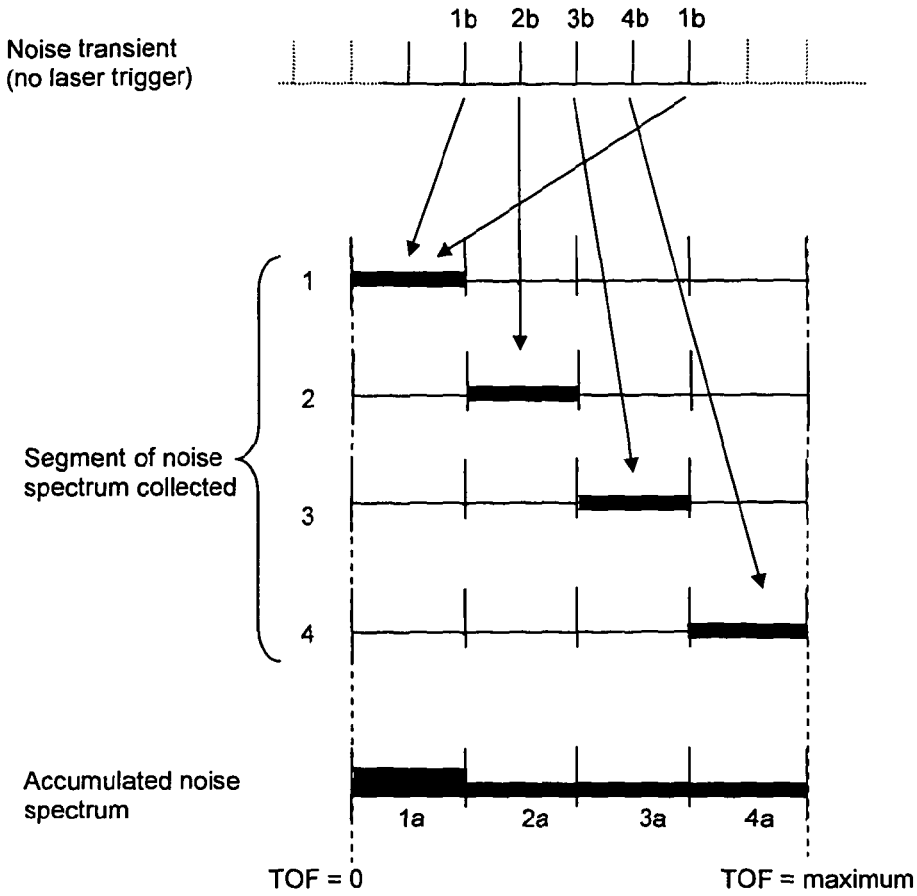
FIG. 8 illustrates how noise mass spectrum data can be acquired in segments.

FIG. 8 illustrates how noise mass spectrum data can be acquired in segments.

In the example illustrated in FIG. 8, the noise mass spectrum data is acquired in four segments (labelled 1, 2, 3 and 4 in FIG. 8). Each segment of noise mass spectrum data is acquired based on the output of an ion detector over a respective one of a plurality of time segments (labelled 1*a*, 2*a*, 3*a* and 4*a* in FIG. 8) during at least one respective noise acquisition cycle (labelled 1*b*, 2*b*, 3*b* and 4*b* in FIG. 8). Each of the plurality of time segments corresponds to a respective time of flight range of ions in the mass spectrometer, and therefore each segment of noise mass spectrum data acquired is representative of noise in the mass spectrometer across a respective mass/charge ratio range.

In the example illustrated in FIG. 8, the segments of noise mass spectrum data are combined to form composite noise mass spectrum data representative of noise in the mass spectrometer across a full mass/charge ratio range by accumulating the segments of noise mass spectrum data produced during each noise acquisition cycle in a memory (e.g. such as the second memory 267 shown in FIG. 4). The "effective" number of noise acquisition cycles is equal to the total number of noise acquisition cycles divided by the number of segments.

In the example illustrated in FIG. 8, the noise acquisition cycles are implemented by not firing the laser (and therefore not generating any ions of sample material) during each noise acquisition cycle, but as explained above, noise acquisition cycles can be implemented in other ways, e.g. by generating ions of sample material but preventing those ions from being detected by an ion detector.

An advantage of acquiring the noise mass spectrum data in a plurality of segments is that the time between (noise) acquisition cycles can be reduced, since the present inventors have found that, in practice, the time taken to store (e.g. by accumulating) noise mass spectrum data representative of noise in the mass spectrometer across a full mass/charge ratio range into memory can take longer than the time taken to produce the noise mass spectrum data in the first place, e.g. because the time taken to store noise mass spectrum data is longer than the time of flight of ions in the mass spectrometer. Acquiring the noise mass spectrum data in a plurality of segments is able to work because systematic noise does not, in general, vary greatly between acquisition cycles.

Example Data

Figure 9:
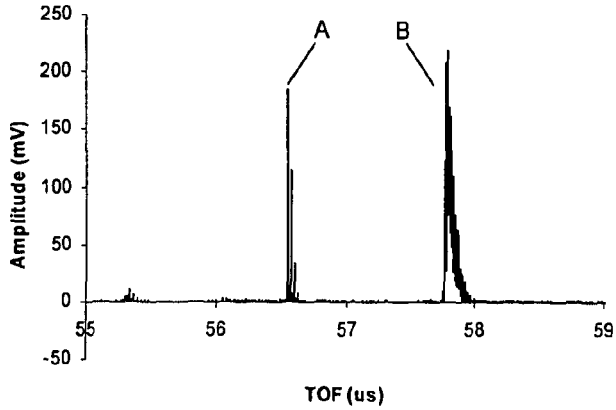
FIGS. 9-11 are mass spectra illustrating the removal of "analogue electronic noise" from mass spectrum data.
Figure 10:
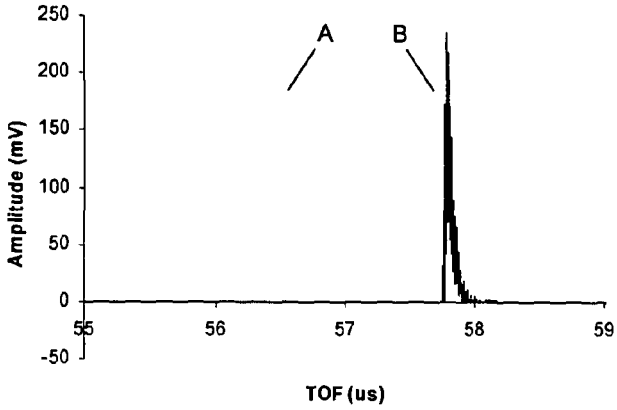
Figure 11:
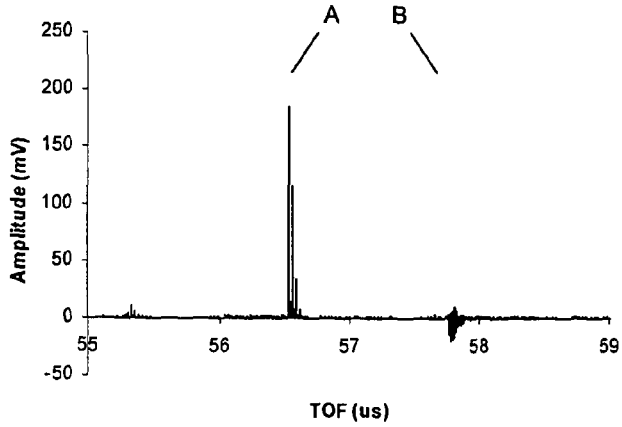

FIGS. 9-11 are mass spectra illustrating the removal of "analogue electronic noise" from mass spectrum data. This data was produced using a mass spectrometer of the type shown in FIG. 1, with a computer (not shown in FIG. 1) being configured to subtract noise mass spectrum data from signal mass spectrum data.

FIG. 9 is a mass spectrum showing signal mass spectrum data produced using a TOF mass spectrometer whose laser was fired for each of 100 signal acquisition cycles to generate a pulse of ions of sample material.

In the mass spectrum shown in FIG. 9, two major sets of peaks A and B can be seen, where it is known that the peaks A are "ion" peaks produced by ions of sample material and the peaks B are "noise" peaks produced by electronic pick up of a high voltage pulse (with an amplitude of a few kilovolts in a rise-time of a few 10s of nanoseconds) located near to the ion detector of the mass spectrometer. The noise peaks B are higher in amplitude than the ion peaks A and are also much broader. Such peaks could easily obscure a real ion peak with the same time-of-flight.

FIG. 10 is a mass spectrum showing noise mass spectrum data produced using the same TOF mass spectrometer whose laser was not fired for each of 100 noise acquisition cycles. Apart from the laser not being fired for each of the 100 noise acquisition cycles such that no ions were generated of the sample material, the noise acquisition cycles were the same as the signal acquisition cycles.

In the mass spectrum shown in FIG. 10, only the noise peaks B can be seen.

FIG. 11 is a mass spectrum showing modified signal mass spectrum data produced by subtracting the noise mass spectrum data (shown in FIG. 10) from the signal mass spectrum data (shown in FIG. 9). This subtraction was achieved by subtracting the amplitude in mV of each time of flight "bin" of the noise mass spectrum data from a corresponding time of flight "bin" of the signal mass spectrum data.

In the mass spectrum shown in FIG. 11, the noise peaks B are reduced by a factor of about 50 in amplitude. Any ion signal with the same time-of-flight as the noise peaks B would now be clearly visible. Over the total of 100 acquisitions the noise averages to very nearly the same level so that only a low level residual noise is left in the modified signal mass spectrum after the noise is subtracted.

Figure 12:
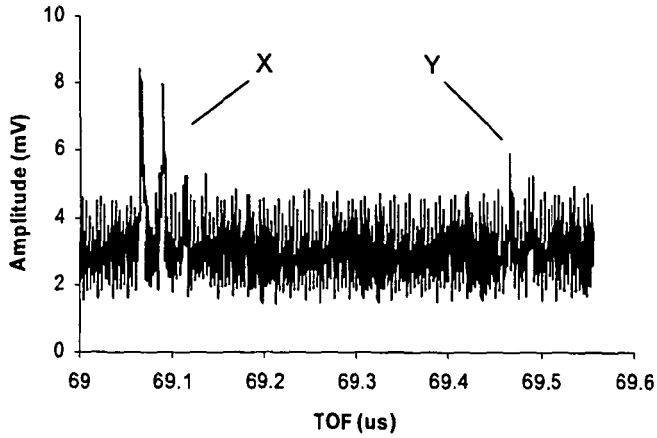
FIGS. 12-14 are mass spectra illustrating the removal of "digital electronic noise" from mass spectrum data.
Figure 13:
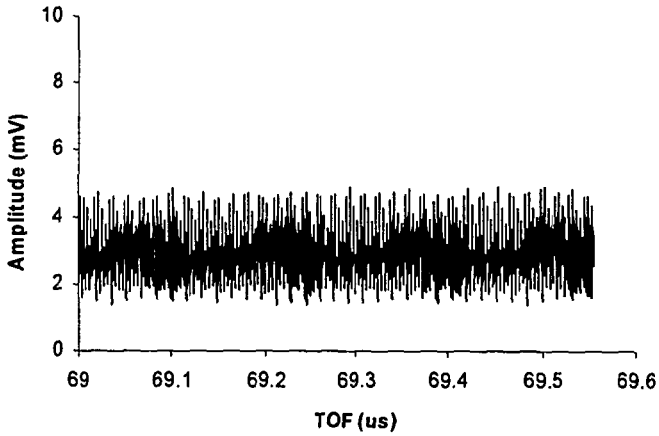
Figure 14:
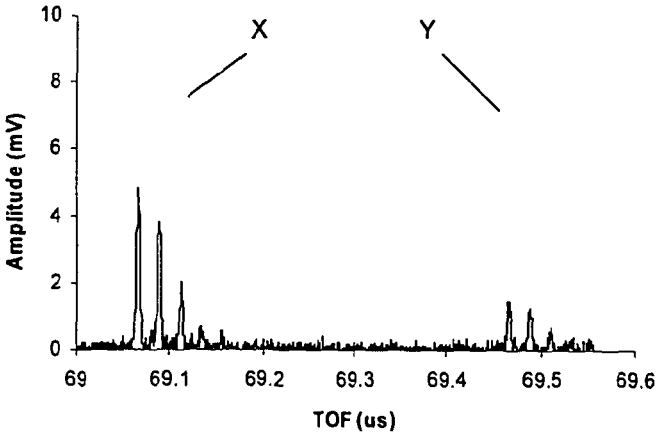

FIGS. 12-14 are mass spectra illustrating the removal of "digital electronic noise" from mass spectrum data.

FIG. 12 shows a mass spectrum showing signal mass spectrum data produced in the same manner as FIG. 9. However, in the signal mass spectrum data shown in FIG. 12, the baseline (the DC level at the input to the analogue-to-digital convertor of the pre-processing unit) has been raised artificially so that the digital structure is more obvious than would normally be the case.

In the mass spectrum shown in FIG. 12, there are two sets of "ion" peaks X and Y that differ in intensity. The set Y is very weak and only just visible above the background digital noise.

FIG. 13 a mass spectrum showing noise mass spectrum data produced in the same manner as FIG. 10. The same number of signal and noise acquisition cycles were performed to produce the mass spectra of FIGS. 12 and 13.

In the noise mass spectrum shown in FIG. 13 only the digital noise can be seen.

FIG. 14 is a mass spectrum showing modified signal mass spectrum data produced by subtracting the noise mass spectrum data (shown in FIG. 13) from the signal mass spectrum data (shown in FIG. 12).

In the mass spectrum shown in FIG. 14, the improvement in signal to noise ratio is very obvious. The digital noise background is reduced by approximately 10 times compared with the signal mass spectrum shown in FIG. 12, such that individual isotopes of the ion peaks are more apparent than in the signal mass spectrum. For the weak ion peaks Y, isotopes are apparent which were previously obscured by the noise.

In the mass spectrum shown in FIG. 14, the advantage of subtracting the digital electronic noise over existing instruments is very apparent. On existing instruments, the pre-processing unit is usually adjusted so that the digital noise is not apparent in the signal spectrum. This is done by applying a small negative offset to the output signal from the ion detector before the input to the pre-processing unit which, in turn only measures positive signal levels. In the example given above the peaks hidden by the noise could not be recorded and would be lost from the data. Thus the invention could provide for an improvement in sensitivity of approximately 10 times based on the above example.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure, without departing from the broad concepts disclosed. It is therefore intended that the scope of the patent granted hereon be limited only by the appended claims, as interpreted with reference to the description and drawings, and not by limitation of the embodiments described herein.

For example, some of the drawings indicate that noise acquisition cycles are implemented by not triggering the firing of a laser (and therefore not generating any ions of sample material) during each noise acquisition cycle, but as explained above, noise acquisition cycles can be implemented in other ways, e.g. by generating ions of sample material but preventing those ions from being detected by an ion detector.

The invention claimed is:

1. A method of producing mass spectrum data using a mass spectrometer having an ion source and an ion detector, wherein the method includes:

acquiring signal mass spectrum data representative of the mass/charge ratio of ions of sample material based on the output of the ion detector during at least one signal acquisition cycle in which ions of sample material generated by the ion source are detected by the ion detector;

acquiring noise mass spectrum data representative of noise in the mass spectrometer based on the output of the ion detector during at least one noise acquisition cycle in which the ion detector does not detect any ions from the ion source; and subtracting the noise mass spectrum data representative of noise in the mass spectrometer from the signal mass spectrum data to produce modified signal mass spectrum data representative of the mass/charge ratio of ions of the sample material, wherein the or each noise acquisition cycle and the or each signal acquisition cycle respectively includes one or more of the following: producing one or more high voltage pulses; supplying one or more high voltage pulses to one or more components of the mass spectrometer; and operating one or more motors of the mass spectrometer, and wherein subtracting the noise mass spectrum data from the signal mass spectrum data includes subtracting an amplitude of each mass/charge ratio bin of the noise mass spectrum data from a corresponding mass/charge ratio bin of the signal mass spectrum data.

2. A method according to claim 1 wherein, in the at least one noise acquisition cycle, either the ion source does not generate any ions of sample material or the ion source generates ions of sample material but the ions generated by the ion source are prevented from being detected by the ion detector.

3. A method according to claim 1 wherein the or each noise acquisition cycle and the or each signal acquisition cycle includes operating electronics for producing mass spectrum data based on an output of the ion detector.

4. A method according to claim 1 wherein the or each noise acquisition cycle is substantially the same as the or each signal acquisition cycle, except that in the or each noise acquisition cycle, either the ion source is not used to generate any ions of sample material or the ion source is used to generate ions of sample material but the ions generated by the ion source are not detected by the ion detector.

5. A method according to claim 1 wherein the signal mass spectrum data is acquired based on the output of the ion detector during a plurality of the signal acquisition cycles and/or the noise mass spectrum data is acquired based on the output of the ion detector during a plurality of the noise acquisition cycles.

6. A method according to claim 1 wherein the method includes acquiring the noise mass spectrum data in a plurality of segments, each segment of noise mass spectrum data being representative of noise in the mass spectrometer across a respective mass/charge ratio range and being acquired based on the output of the ion detector during at least one respective noise acquisition cycle.

7. A method according to claim 6 further including subtracting the plurality of segments of noise mass spectrum data from the signal mass spectrum data to produce modified signal mass spectrum data representative of the mass/charge ratio of ions of the sample material.

8. A method according to claim 1 wherein a plurality of signal acquisition cycles and a plurality of noise acquisition cycles are performed in consecutive cycles of the mass spectrometer, with a time difference between the consecutive cycles of 1 second or less.

9. A method according to claim 1 wherein:

the signal mass spectrum data is acquired based on the output of the ion detector during a plurality of the signal acquisition cycles, the noise mass spectrum data is acquired based on the output of the ion detector during a plurality of the noise acquisition cycles, and the plurality of signal acquisition cycles are interleaved with the plurality of noise acquisition cycles.

10. A method according to claim 9 wherein the plurality of signal acquisition cycles and the plurality of noise acquisition cycles are performed in consecutive cycles of the mass spectrometer, with a time difference between the consecutive cycles of 100 milliseconds or less.

11. A method according to claim 1 wherein the method includes scaling the signal mass spectrum data and/or the noise mass spectrum data according to the number of acquisition cycles used to acquire the data.

12. A method according to claim 1 wherein the method includes subtracting the noise mass spectrum data from the signal mass spectrum data in a pre-processing unit coupled to a processing unit for analysing signal mass spectrum data.

13. A method according to claim 12 wherein the method includes acquiring the signal and/or the noise mass spectrum data in the pre-processing unit.

14. A method according to claim 12 wherein the method includes storing the signal mass spectrum data in a first memory in the pre-processing unit and storing the noise mass spectrum data in a second memory in the pre-processing unit.

15. A method according to claim 1 wherein the ion source includes a laser for ionising sample material by firing light at the sample material.

16. A method according to claim 1 wherein the ion source is a MALDI ion source.

17. A method according to claim 1 wherein the mass spectrometer is a TOF mass spectrometer.

18. A mass spectrometer having:

an ion source for generating ions of sample material;

an ion detector for detecting ions of sample material generated by the ion source;

a first data acquisition means for acquiring signal mass spectrum data representative of the mass/charge ratio of ions of sample material based on the output of the ion detector during at least one signal acquisition cycle in which ions of sample material generated by the ion source are detected by the ion detector;

a second data acquisition means for acquiring the noise mass spectrum data representative of noise in the mass spectrometer based on the output of the ion detector during at least one noise acquisition cycle in which the ion detector does not detect any ions from the ion source; and a subtraction means for subtracting noise mass spectrum data representative of noise in the mass spectrometer from signal mass spectrum data produced by the first data acquisition means to produce modified signal mass spectrum data representative of the mass/charge ratio of ions of the sample material, wherein the or each noise acquisition cycle and the or each signal acquisition cycle respectively includes one or more of the following: producing one or more high voltage pulses; supplying one or more high voltage pulses to one or more components of the mass spectrometer; and operating one or more motors of the mass spectrometer, and wherein subtracting the noise mass spectrum data from the signal mass spectrum data includes subtracting an amplitude of each mass/charge ratio bin of the noise mass spectrum data from a corresponding mass/charge ratio bin of the signal mass spectrum data.

* * * * *